US008782933B2

(12) United States Patent
Jay

(10) Patent No.: US 8,782,933 B2
(45) Date of Patent: Jul. 22, 2014

(54) MEDIA DISPLAY SYSTEM FOR SKI-LIFT CHAIR

(75) Inventor: Matthew Jay, Aspen, CO (US)

(73) Assignee: Ripple Resort Media, Inc., Aspen, CO (US)

( * ) Notice: Subject to any disclaimer, the term of this patent is extended or adjusted under 35 U.S.C. 154(b) by 0 days.

(21) Appl. No.: 13/350,433

(22) Filed: Jan. 13, 2012

(65) Prior Publication Data

US 2012/0110880 A1 May 10, 2012

Related U.S. Application Data

(63) Continuation of application No. 12/606,087, filed on Oct. 26, 2009, now Pat. No. 8,096,067, which is a continuation of application No. 11/696,819, filed on Apr. 5, 2007, now Pat. No. 7,895,778, which is a continuation-in-part of application No. 11/674,062, filed on Feb. 12, 2007, now abandoned, which is a continuation-in-part of application No. 10/749,545, filed on Dec. 31, 2003, now Pat. No. 7,174,665, which is a continuation of application No. 09/481,641, filed on Jan. 12, 2000, now abandoned.

(60) Provisional application No. 60/791,684, filed on Apr. 13, 2006.

(51) Int. Cl.
*G09F 3/18* (2006.01)

(52) U.S. Cl.
USPC ..... 40/320; 40/308

(58) Field of Classification Search
USPC ..... 40/611.01, 320, 611.05, 642.02, 650, 40/651, 308, 654.01, 660, 661, 661.12, 40/665, 666, 727, 904, 591, 592, 735, 40/781; 297/488
See application file for complete search history.

(56) References Cited

U.S. PATENT DOCUMENTS

| | | | | |
|---|---|---|---|---|
| 1,394,881 | A | 10/1921 | Bardera | |
| 1,489,113 | A | 4/1924 | Brookbank | |
| 1,786,883 | A * | 12/1930 | Zahonyi | 40/607.12 |
| 1,996,288 | A | 4/1935 | Galt | |
| 2,507,875 | A | 5/1950 | Williams | |
| 2,631,468 | A | 3/1953 | Thomas | |
| 2,864,189 | A * | 12/1958 | Campbell | 40/308 |

(Continued)

OTHER PUBLICATIONS

U.S. Appl. No. 11/696,819 Response to Office Action filed Dec. 28, 2009, 29 pages.

(Continued)

*Primary Examiner* — Charles A Fox
*Assistant Examiner* — Shin Kim
(74) *Attorney, Agent, or Firm* — Lathrop & Gage LLP

(57) ABSTRACT

An apparatus for displaying printed media includes a base member, clamps for securing the base member to a restraint bar of a ski-lift chair, and a top panel coupled with the base member such that the printed media is viewable from the ski-lift chair through the panel. A method of advertising at a ski area includes integrating advertising displays with ski-lift chairs of the ski area. Each of the advertising displays has one or more places to secure printed media. The method also includes inserting printed media within each of the advertising displays. Another method of advertising at a ski area includes integrating printed media within viewable regions of at least one media display system, and integrating the media display system with a ski-lift chair of the ski area.

19 Claims, 16 Drawing Sheets

(56) References Cited

U.S. PATENT DOCUMENTS

| | | | | | |
|---|---|---|---|---|---|
| D206,518 | S | | 12/1966 | Evans | |
| 3,555,715 | A | * | 1/1971 | Shell | 40/618 |
| 3,611,604 | A | * | 10/1971 | Jahn | 40/768 |
| 3,616,558 | A | * | 11/1971 | Saltzman | 40/711 |
| 3,877,165 | A | * | 4/1975 | Lumbard | 40/779 |
| 3,918,187 | A | | 11/1975 | Vogele | |
| 4,059,914 | A | * | 11/1977 | Dobson | 40/611.01 |
| 4,094,085 | A | | 6/1978 | Nolan, Jr. | |
| 4,104,818 | A | | 8/1978 | Hrabik | |
| 4,217,711 | A | | 8/1980 | Spresser et al. | |
| 4,291,475 | A | | 9/1981 | Schoemer | |
| 4,333,253 | A | | 6/1982 | Cooper | |
| 4,596,083 | A | * | 6/1986 | Thompson | 40/473 |
| 4,624,018 | A | | 11/1986 | Kurtz | |
| 4,685,701 | A | * | 8/1987 | Amundson et al. | 281/42 |
| 4,930,436 | A | * | 6/1990 | Newman | 73/170.05 |
| 5,012,600 | A | | 5/1991 | Wang | |
| 5,116,204 | A | * | 5/1992 | Power et al. | 40/606.14 |
| 5,237,767 | A | * | 8/1993 | Kringel et al. | 40/652 |
| 5,301,443 | A | | 4/1994 | Gori | |
| 5,410,827 | A | | 5/1995 | Smith | |
| 5,423,141 | A | * | 6/1995 | Myles et al. | 40/586 |
| 5,685,095 | A | | 11/1997 | DeMasi | |
| 5,870,841 | A | | 2/1999 | Brody et al. | |
| 5,983,543 | A | * | 11/1999 | Hillstrom | 40/574 |
| D419,604 | S | | 1/2000 | Emmett | |
| 6,039,495 | A | | 3/2000 | Zimmerman et al. | |
| 6,058,638 | A | | 5/2000 | Slåttebrekk | |
| 6,076,791 | A | * | 6/2000 | Rand et al. | 248/229.24 |
| 6,209,248 | B1 | * | 4/2001 | Reinhard | 40/768 |
| 6,212,809 | B1 | * | 4/2001 | Gaule | 40/660 |
| 6,299,119 | B1 | * | 10/2001 | Dunning | 248/346.03 |
| 6,428,913 | B1 | * | 8/2002 | Yoshihara et al. | 428/702 |
| 6,438,883 | B1 | * | 8/2002 | Kacius | 40/735 |
| 6,467,210 | B1 | * | 10/2002 | Chang | 40/792 |
| 6,550,170 | B1 | * | 4/2003 | Cooper et al. | 40/607.12 |
| 6,796,066 | B2 | * | 9/2004 | Champnella, II | 40/735 |
| 6,918,200 | B2 | | 7/2005 | Pena | |
| 6,948,272 | B1 | * | 9/2005 | Olivier et al. | 40/661.12 |
| 6,976,660 | B2 | * | 12/2005 | Lapointe et al. | 248/218.4 |
| 6,986,220 | B2 | * | 1/2006 | Kaulbach | 40/506 |
| 7,325,345 | B2 | * | 2/2008 | Hailo | 40/610 |
| 7,383,654 | B2 | * | 6/2008 | Olivier et al. | 40/661.12 |
| 7,411,361 | B2 | | 8/2008 | Agustsson et al. | |
| 7,412,791 | B2 | * | 8/2008 | Bradley et al. | 40/611.06 |
| 7,424,785 | B2 | | 9/2008 | Feroli et al. | |
| 7,425,311 | B2 | * | 9/2008 | Gfrorer et al. | 422/561 |
| 7,441,361 | B2 | * | 10/2008 | Rowan | 40/743 |
| 2002/0096610 | A1 | * | 7/2002 | Fernandez | 248/218.4 |
| 2002/0156681 | A1 | | 10/2002 | Dark | |

OTHER PUBLICATIONS

U.S. Appl. No. 11/696,819 Office Action mailed Aug. 26, 2009, 10 pages.
U.S. Appl. No. 11/696,819 Response to Office Action filed May 26, 2009, 12 pages.
U.S. Appl. No. 11/696,819 Office Action mailed Feb. 26, 2009, 10 pages.
U.S. Appl. No. 10/749,545 Notice of Allowance mailed Oct. 4, 2006, 4 pages.
U.S. Appl. No. 10/749,545 Response to Office Action filed Jul. 17, 2006, 42 pages.
U.S. Appl. No. 10/749,545 Office Action mailed Mar. 15, 2006, 13 pages.
U.S. Appl. No. 10/749,545 Response to Office Action filed Dec. 28, 2005, 10 pages.
U.S. Appl. No. 10/749,545 Office Action mailed Aug. 1, 2005, 8 pages.
U.S. Appl. No. 10/749,545 Response to Notice of Noncompliant Amendment filed May 19, 2005, 7 pages.
U.S. Appl. No. 10/749,545 Notice of Noncompliant Amendment mailed Feb. 17, 2005, 2 pages.
U.S. Appl. No. 10/749,545 Response to Office Action filed Nov. 22, 2004, 12 pages.
U.S. Appl. No. 10/749,545 Examiner Interview Summary mailed Nov. 2, 2004, 3 pages.
U.S. Appl. No. 10/749,545 Office Action mailed May 17, 2004, 6 pages.
PCT/US01/00929 International Search Report mailed Jun. 28, 2001, 1 page.
PCT/US01/00929 International Preliminary Examination Report, Aug. 15, 2002, 12 pages.
U.S. Appl. No. 11/696,819 Response to Office Action filed Sep. 17, 2010, 9 pages.
U.S. Appl. No. 11/696,819 Office Action mailed Jul. 28, 2010, 11 pages.
Statement under MPEP §2001.06(c) dated Aug. 25, 2011, 1 page.
Select File History from related U.S. Appl. No. 12/606,087, dated Sep. 2, 2010 through Dec. 2, 2011, 104 pages.
Case 1:12-cv-00125-REB, Complaint for Patent Infringement and Jury Demand filed Jan. 18, 2012, 5 pages.
Civil Action No. 12-cv-00608-MSK, First Amended Complaint for Patent Infringement and Jury Demand filed Mar. 26, 2012, 11 pages.

* cited by examiner

MEDIA DISPLAY SYSTEM FOR SKI-LIFT CHAIR

CROSS REFERENCE TO RELATED APPLICATIONS

This application is a continuation of commonly-owned U.S. patent application Ser. No. 12/606,087, filed 26 Oct. 2009, now U.S. Pat. No. 8,096,067, which is a continuation of U.S. patent application Ser. No. 11/696,819, filed 5 Apr. 2007, now U.S. Pat. No. 7,895,778, which is a continuation-in-part of U.S. patent application Ser. No. 11/674,062, filed 12 Feb. 2007, now abandoned, which is a continuation-in-part of U.S. patent application Ser. No. 10/749,545, filed 31 Dec. 2003, now U.S. Pat. No. 7,174,665, which is a continuation of U.S. patent application Ser. No. 09/481,641, filed 12 Jan. 2000, now abandoned. This application also claims the benefit of priority to U.S. Provisional Patent Application No. 60/791,684, filed 13 Apr. 2006, through U.S. patent application Ser. Nos. 11/674,062 and 11/696,819 identified above. All of the above-identified patent applications are incorporated herein by reference.

BACKGROUND OF THE INVENTION

Skiing and snowboarding are popular sports enjoyed by many people throughout the world. Winter resorts typically have ski-lifts that include ski-lift chairs having a restraint bar across the front to prevent riders from falling out. Winter resorts also often have trail signs and maps posted at locations such as the tops and bottoms of the ski lifts, and at trail intersections; such fixed signage is useful when a viewer is nearby. However, skiers and snowboarders spend a good deal of time riding the ski-lifts, and can use such time reviewing trail maps if they are handy. Riders on ski-lift chairs may also be a somewhat captive audience for advertising materials that may be displayed to the riders.

The present invention relates to a media display system for a ski-lift chair, and more specifically a system that can be mounted to a restraint bar along the front side of the chair.

SUMMARY OF THE INVENTION

In one embodiment, an apparatus for displaying printed media includes a base member, clamps for securing the base member to a restraint bar of a ski-lift chair, and a top panel coupled with the base member such that the printed media is viewable from the ski-lift chair through the panel.

In one embodiment, an apparatus for displaying printed media includes a base member, clamps that secure the base member to a restraint bar of a ski-lift chair, and a transparent plastic panel of at least several mils thickness. The plastic panel has printed media reverse printed thereon. Left and right sides of the plastic panel are swept rearwardly from a central region thereof. The plastic panel is coupled with the base member such that the printed media is viewable from the ski-lift chair through the transparent panel.

In one embodiment, a display apparatus for printed media includes a body member having a bottom surface and a top surface. A frame member mounts over the top surface of the body member and holds the printed media between the frame member and the body member. Two or more metal holding clamps couple to the bottom surface of the body member for attaching the display apparatus to a restraint bar of a ski-lift chair.

In one embodiment, a display apparatus for printed media includes a body member having a bottom surface and a top surface, a frame member comprising a top panel, for mounting over the top surface of the body member, and printed media, including a trail map and advertising, that is reverse printed on the top panel. Two or more metal holding clamps couple to the bottom surface of the body member for non-rotationally attaching the display apparatus to a restraint bar of a ski-lift chair.

In one embodiment, apparatus for displaying printed media includes (a) a ski-lift chair having a restraint bar, a body member having a bottom surface and a top surface, (b) two or more metal holding clamps coupled to the bottom surface of the body member that attach the display apparatus to the restraint bar, (c) a frame member comprising a top panel that mounts over the top surface of the body member, and (d) printed media that is reverse printed on the top panel for visibility to a rider of the ski-lift chair.

In one embodiment, a media display system for a ski-lift chair includes a base member. A transparent panel mounts with the base member, and the base member and the transparent panel collectively form a leading edge that faces forwardly with respect to the ski-lift chair and is swept rearwardly, along a width of the leading edge, from a central region thereof. The system also includes printed media, including a trail map and advertising, mounted in a viewable region of the transparent panel. The body member mounts with a restraint bar of a ski-lift chair such that the viewable region is visible to a rider of the ski-lift chair.

In one embodiment, a method of advertising at a ski area includes integrating advertising displays with ski-lift chairs of the ski area. Each of the advertising displays has one or more places to secure printed media. The method also includes inserting printed media within each of the advertising displays.

In one embodiment, an advertising method includes integrating an advertising display onto a restraint bar of a ski-lift chair. The advertising display forms windows to secure distinct printed media therein. The method also includes inserting printed media into each of the windows to show advertisements to a person sitting on the ski-lift chair.

In one embodiment, a method of advertising at a ski area includes integrating printed media within viewable regions of at least one media display system, and integrating the media display system with a ski-lift chair of the ski area.

In one embodiment, a method of advertising at a ski area includes providing a plurality of media display systems, reverse printing at least a trail map and advertising material on clear plastic of each of the media display systems, and integrating each of the media display systems with a respective ski-lift chair of the ski area.

BRIEF DESCRIPTION OF THE DRAWINGS

Reference will now be made to the attached drawings, where like numbers may represent similar elements in multiple figures.

DETAILED DESCRIPTION OF THE DRAWINGS

Figure 1:
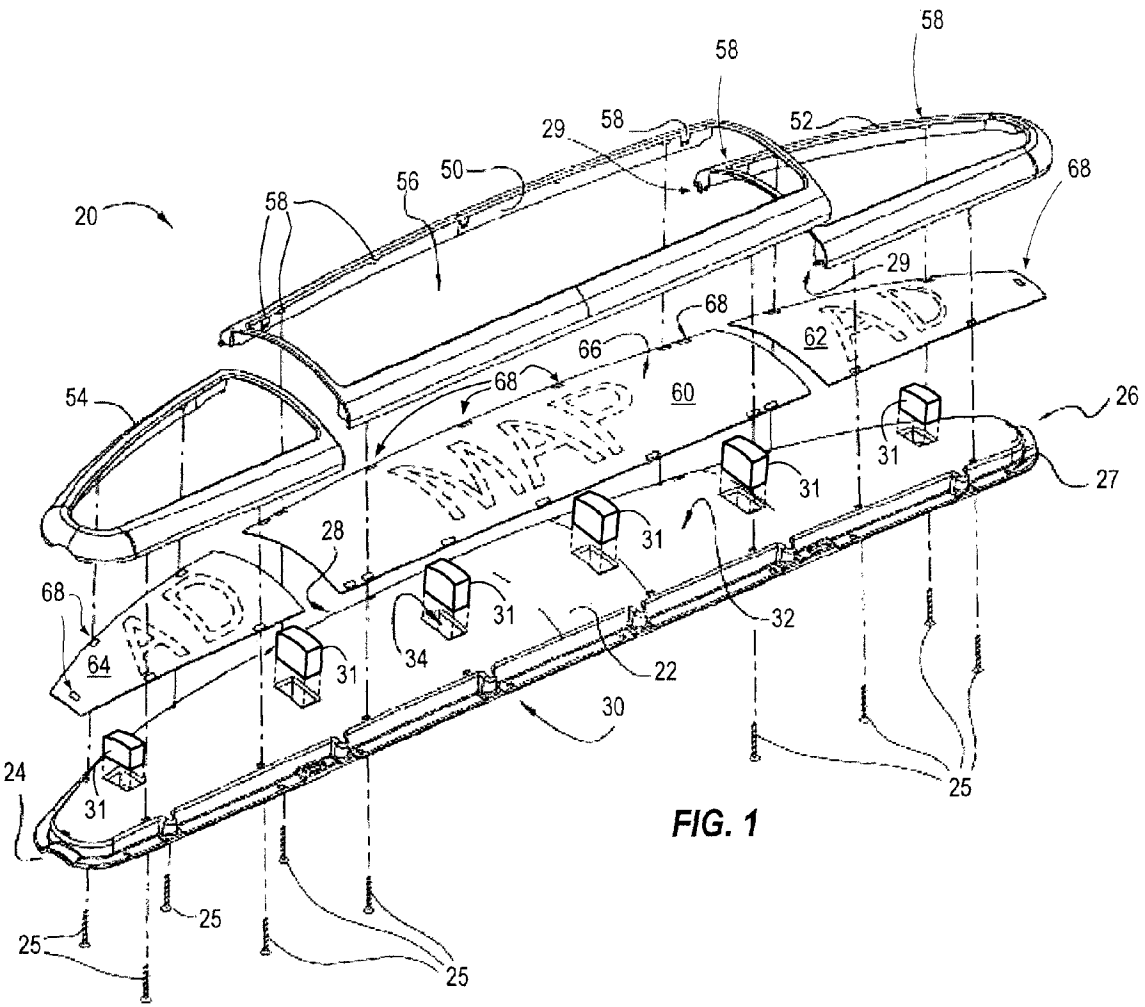
FIG. 1 is an exploded top rear perspective view of a media display system in accord with an embodiment.

The present disclosure may be understood by reference to the following detailed description of the drawings included herewith. It is noted that, for purposes of illustrative clarity, certain drawings and elements may not be drawn to scale. Numbering without parentheses is used to denote a genus (e.g., media display system 100), whereas numbering with parentheses denotes a species within a genus (e.g., media display system 100(2)). Multiple elements within a figure may not be labeled for the sake of clarity.

FIGS. 1-7 show embodiments of a media display system 20 for a ski-lift chair. System 20 includes body member 22, and has a left side 24, a right side 26, a front side 28 and a rear side 30.

One or more frame members are provided, such as central frame member 50, right frame member 52 and left frame member 54. Preferably, each of these frame members partially or completely encloses a central viewable region, such as viewable region 56 through which printed media 60, 62 and 64 may be seen. Printable media 60, 62 and 64 are illustrated in FIG. 1 and show the words "MAP" and "AD" in dashed lines to represent imagery thereon. In one embodiment, each of the printed media has a top side 66 and an opposite side (hidden in the view of FIG. 1) facing downwardly towards body member 22. Printed media 60, 62 and 64 may be protected by or integrated with a clear plastic film of at least several mills in thickness. Moreover, the imagery may be reverse printed in the bottom side of such film. For example, the bottom side of printed media 60 may first be reverse printed with map indicia, trees, and so forth, and subsequently printed with a backing color (e.g. white ink). In this way, when printed media 60 is mounted between frame member 50 and body member 22, the top surface 66 which typically is exposed through viewable region 56 protects the printed ink from scuffing, wear and the like.

As also illustrated in FIG. 1, one approach is to utilize three frames: left frame member 54, right frame member 52 and central frame member 50. It may be preferable to have a map in central region 50 to show paths and terrain of a ski area in which the ski-lift chair is located, with advertisements in frames 52 and 54. Such advertisements may be sold or leased as a revenue source. Naturally, other combinations may be used, including advertisements in the middle and maps on either side, all advertisements, all maps, or other printed media. It is also possible to have a different number of frame members than the three frame members shown in FIG. 1. It is possible to have permanently installed printed media. However, it may be preferred to have interchangeable printed media 60, 62 and 64, held between the frames and the body member so that the printed media may be changed from time to time.

Optionally, printed media 60, 62 and 64 may have holes cut therein such as a hole opening 68 through which a downwardly projecting tab 58 may pass. Preferably, 58 is equipped with a latch tab which snaps into place in a corresponding opening in body member 22 to hold frame 50 in place. As illustrated in FIG. 1, a plurality of tabs 58 with and/or without latch tabs may be provided, with corresponding openings 68 punched or otherwise formed in printed media 60, 62 and 64. Tabs 58 thereby provide registry and maintain printed media 60, 62 and 64 flat and smooth along a top surface 32 of body member 22. Preferably, one or more fasteners such as screws 25 are screwed through holes, such as hole 27 (see FIG. 1) located in a perimeter flange of body member 22. Only a few screws 25 are shown in FIG. 1, for clarity of illustration. Screws 25 are screwed upwardly into the corresponding frame member to help hold it in place. In a preferred embodiment, left and right frame members 52 and 54 are held in place by only two screws 25 and two hooks 29 in opposite inboard ends of frame 52 and 54, two such hooks 29 shown associated with frame 52 in FIG. 1 (other hooks being associated with frame 54 but hidden in the perspective view of FIG. 1).

Figure 5:
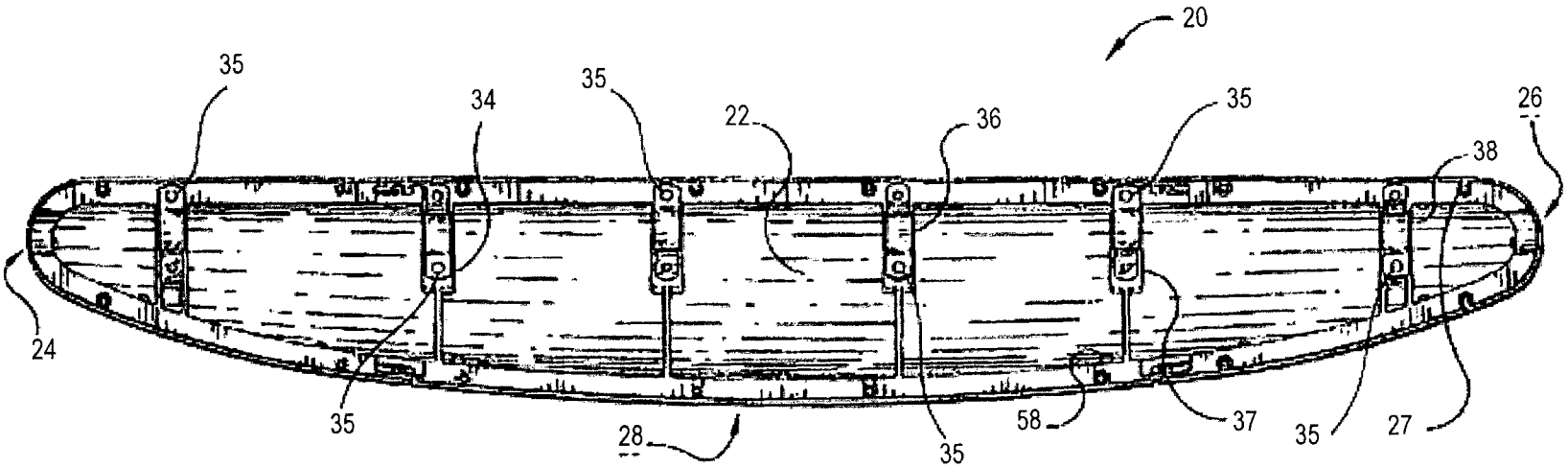
FIG. 5 is a bottom plan view of the device of FIG. 1.
Figure 6:
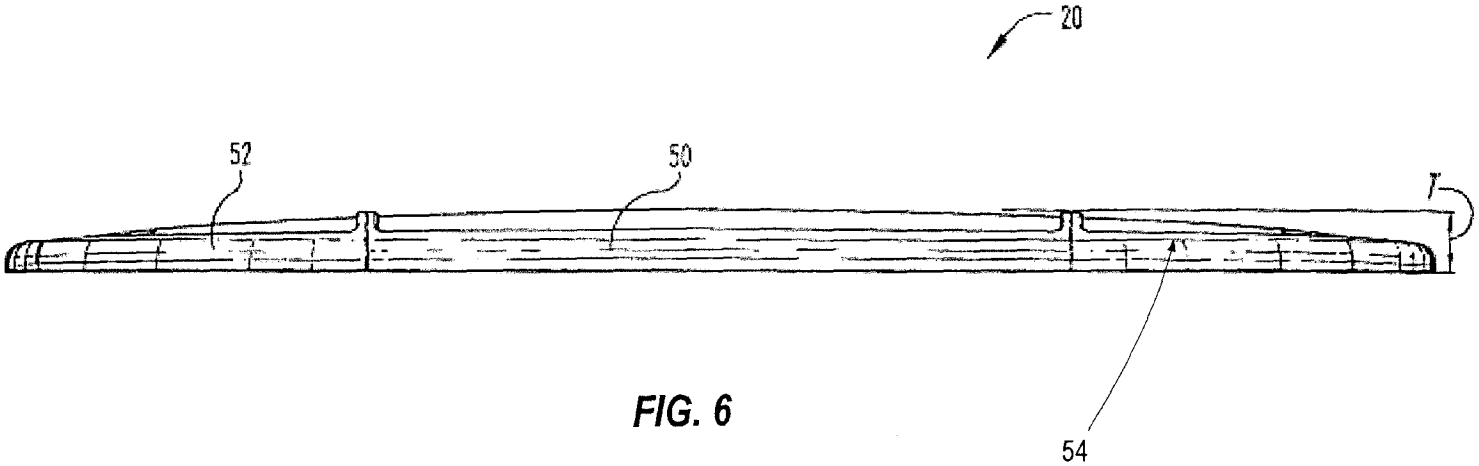
FIG. 6 is a front elevation view of the device of FIG. 1.
Figure 7:
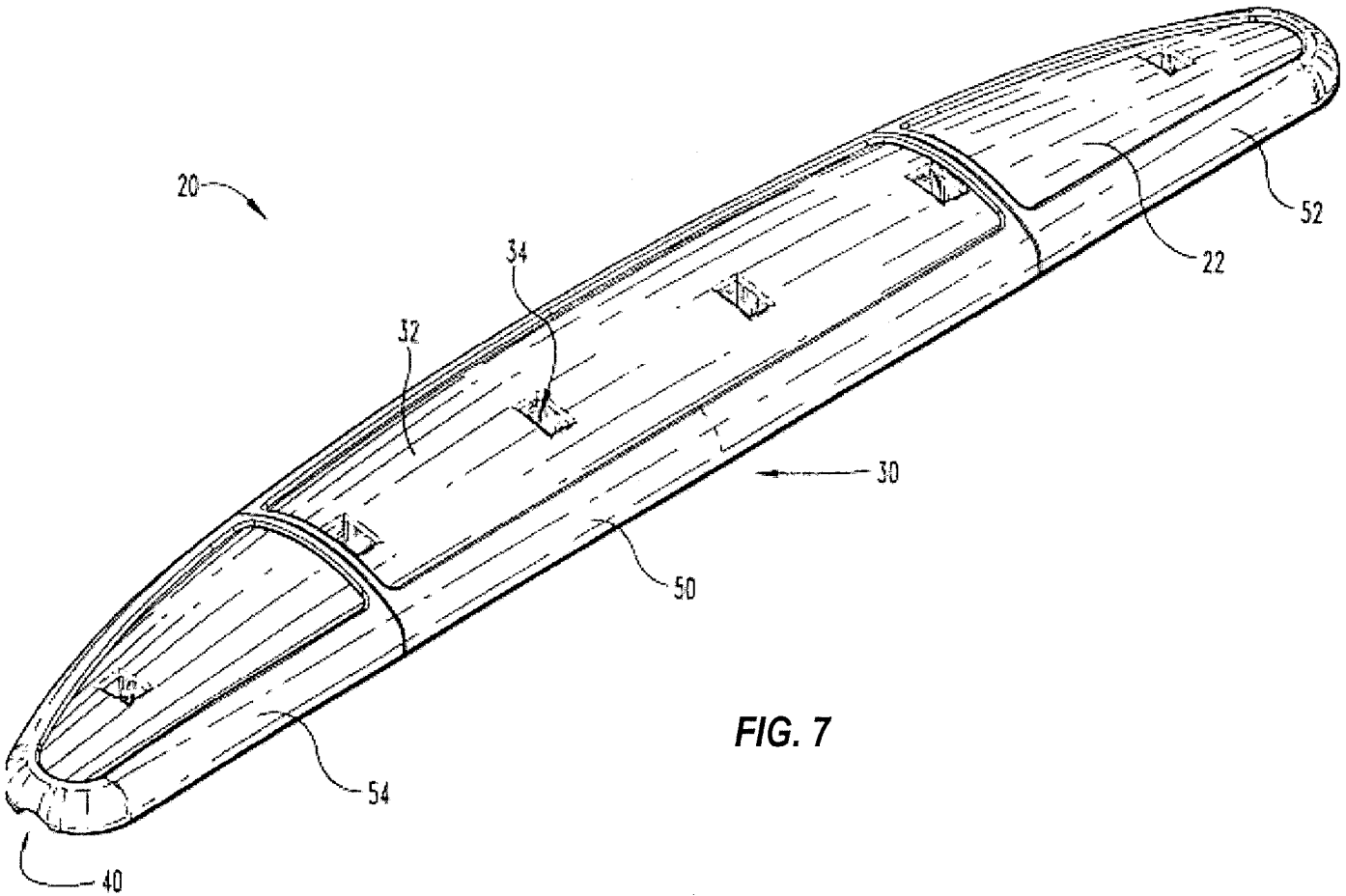
FIG. 7 is a top rear perspective view of the device of FIG. 1.

Optionally, body member 22 includes one or more topside recesses, such as topside recess 34, molded therein to provide dimensional stiffness in body member 22 and to provide a bottom surface on which to mount loop members 36, 37 and 38 (see FIG. 5). Loop members 36, 37 and 38 may be formed from metal strips wrapped in a loop which goes around a restraint of a ski-lift chair. Loop members 36, 37 and 38 preferably have a top flange and bottom flange projecting tangentially from the circle formed by the loop, with the top flange and bottom flange having aligned holes drilled therein. A screw 35 passes through both of the aligned holes and secures the corresponding loop member to a bottom side of one of the topside recesses 34 of body member 22. For example, FIG. 5 shows one such screw 35 holding loop member 36 in place screwed into recess 34 of body member 22. Preferably, body member 22 is molded with twin screw holes corresponding to each topside recess 34, one of the twin holes being disposed on a forward side and the other on a rearward side of each recess 34. In this way, as illustrated in FIG. 5 by the staggering position of loop members 36, 37 and 38, the loop members may be oriented such that the flanges and screws 35 holding each loop member in place are alternately in forward and reverse configurations along a length of body member 22. In this way, the screw holes are in a non-linear arrangement, providing a more stable and secure base for mounting system 20 to the restraint bar of the chair lift. As the screws 35 are tightened down, the flanges are urged together, cinching the loop members tightly around the restraint, gripping it tightly and preventing system 20 from rotating with respect to the restraint.

Optionally, a block 31 inserts into each of topside recesses 34 of body member 22, as shown, thereby capping topside recesses 34 to eliminate weak spots under printed media 60, 62 and 64. Blocks 31 support printed media 60, 62 and 64 over recesses 34, which helps prevent damage and vandalism of printed media 60, 62 and 64 by foreign objects (e.g., ski poles).

Figure 2:
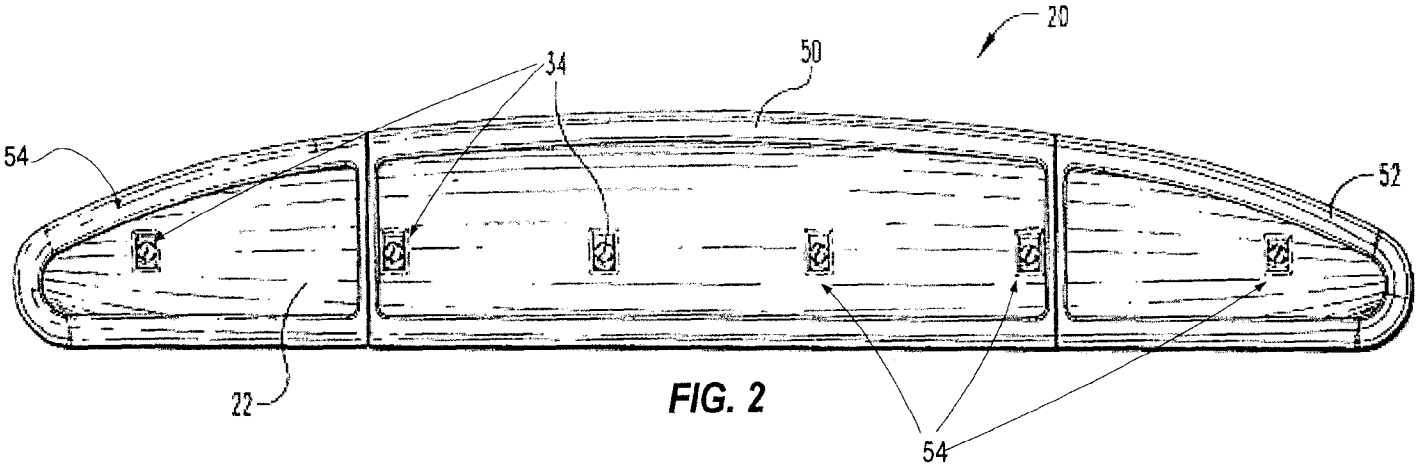
FIG. 2 is a top plan view of the system of FIG. 1.
Figure 3:
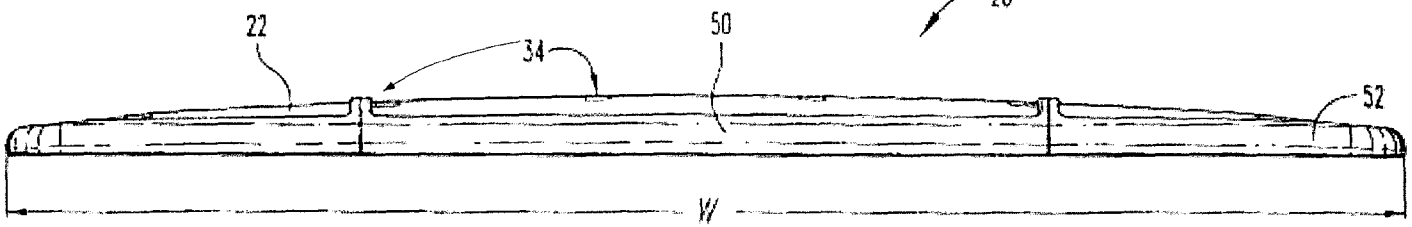
FIG. 3 is a rear elevation view of the device of FIG. 1.
Figure 4:
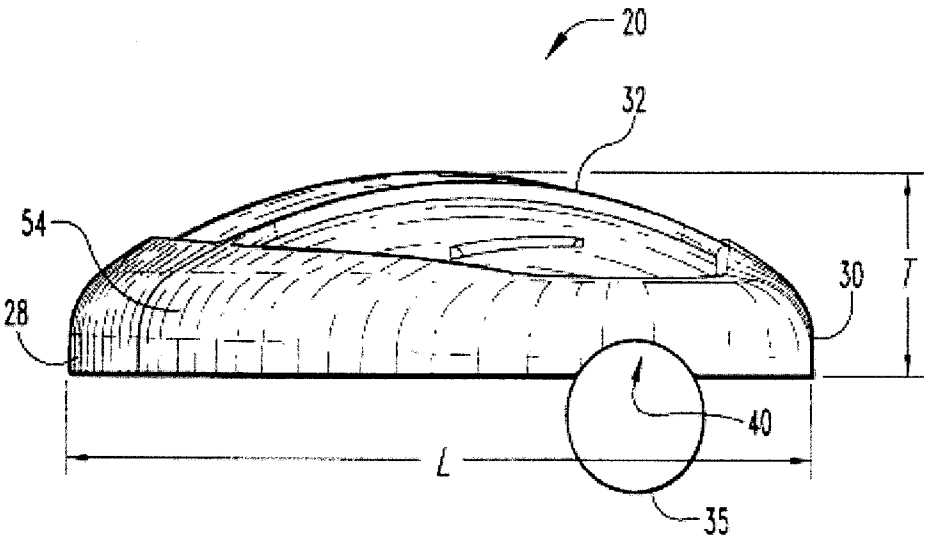
FIG. 4 is a left side elevation view of the device of FIG. 1, the right side elevation view being a mirror image thereof.

Preferably, system 20 has an ornamental appearance which is also aerodynamic. In this regard, one aspect of this is that the length "L" (see FIG. 4) is greater than the thickness "T" of system 20, and preferably is at least two times, and preferably three times greater than thickness "T". Moreover, top surface 32 is preferably convex along the direction of the length from front 28 to rear 30. As illustrated in FIG. 4, semi-cylindrical recess 40 runs along the entire width of system 20 so as to receive the restraint bar therein. Note that as shown in FIG. 4, the metal holding clamps looped around the restraint bar are removed. As illustrated in FIGS. 2 and 5, the front or leading edge 28 faces forwardly with respect to the ski-lift chair and is swept rearwardly along the width of the leading edge from a central region thereof (e.g., approximately the central ⅓ thereof) to the left and the right sides of body member 22. Left side 24 and right side 26 are rounded when viewed from a plan view. The rounding of left sides 24 and 26 facilitates stability of system 20 on a ski-lift chair. That is, rounded sides 24 and 26 present less wind resistance than if sharper corners were present, so that wind forces which might otherwise tend to rotate system 20 about the restraint bar are reduced. Rounded sides 24 and 26 may also facilitate stability of the ski-lift chair itself (as compared to a corresponding system having sharper corners) since such chairs are generally mounted to a cable utilizing pivots, such that high winds cause the chairs to swing.

Figure 8:
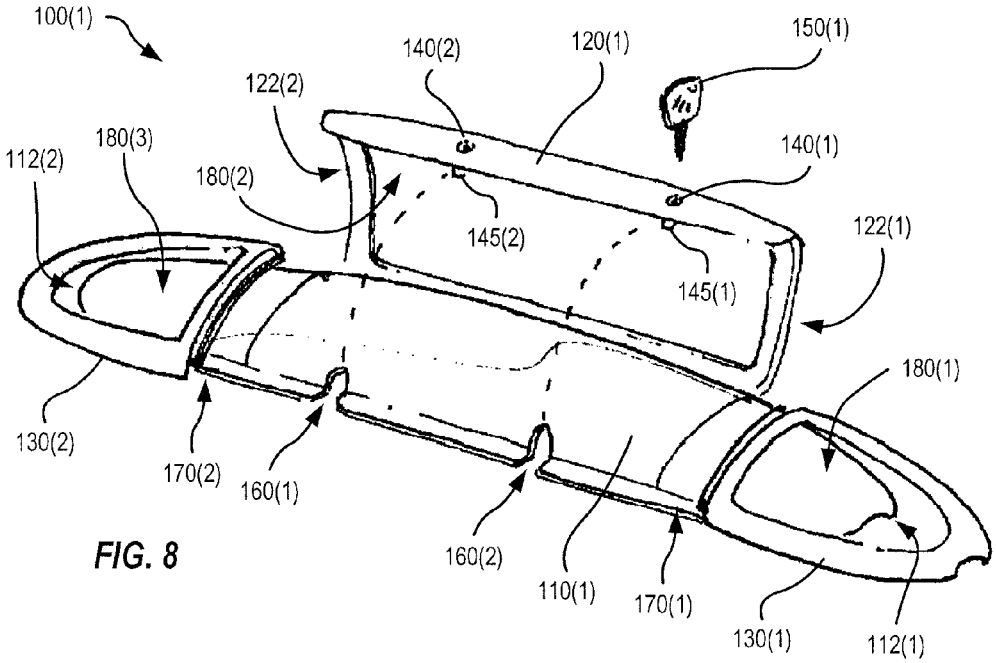
FIG. 8 shows an exploded view of a media display system that is attachable to a restraint bar of a ski-lift chair, in accord with an embodiment.

FIG. 8 shows an exploded view of a media display system 100(1) that is attachable to a restraint bar that lowers in front of a ski-lift chair (not shown). FIG. 8 may not be drawn to scale. Printed media (not shown in FIG. 1) may be displayed by system 100(1), which is configured for keyed access, as explained immediately hereafter. Such printed media may include, for example, trail maps, ski-lift instructions, safety information, and advertising material.

System 100(1) includes a base member 110(1), a center panel 120(1) shown in an open position, and side panels 130(1) and 130(2) shown detached from base member 110(1). Side panels 130(1) and 130(2) faun flanges (not shown) configured to slide into grooves 170(1) and 170(2) of base member 110(1). Each of center panel 120(1) and side panels 130(1) and 130(2) include a window 180(1)-180(3), as shown. Each of windows 180(1)-180(3) may include a transparent material such as glass or clear plastic, or windows 180(1)-180(3) may simply be openings in each of center panel 120(1) and side panels 130(1) and 130(2). Center panel 120(1) connects to base member 110(1) by means of hooks or hinges (hidden from view behind base member 110(1) in the viewing angle of FIG. 1) such that panel 120(1) can swing down into a closed position onto base member 110(1).

Figure 9:
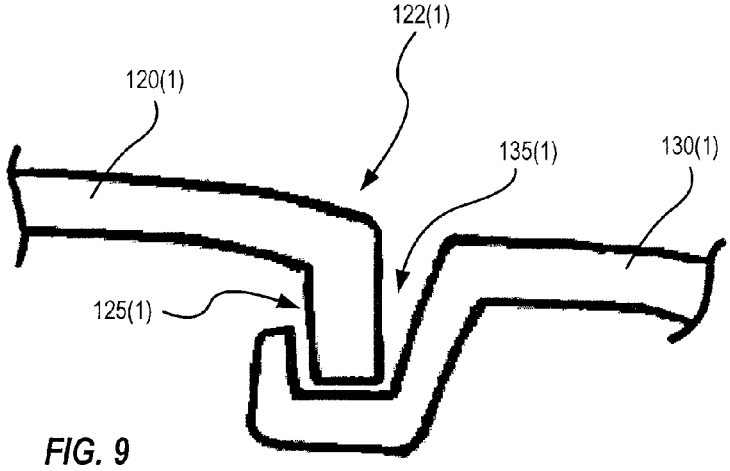
FIG. 9 is a detail view showing how an edge of a center panel holds a side panel in place in the media display system of FIG. 8.

Installation of printed media into system 100(1) may begin with center panel 120(1) in the open position and side panels 130(1) and 130(2) at least partially removed from base member 110(1). Printed media may be placed on base member 110(1), or affixed to an underside of each of center panel 120(1) and side panels 130(1) and 130(2). Once printed media are in place, flanges of side panels 130(1) and 130(2) slide into grooves 170(1) and 170(2) until each of panels 130(1) and 130(2) abuts one of ends 112(1) and 112(2) of base member 110(1). Next, center panel 120(1) swings into a closed position, such that locking tabs 145(1) and 145(2) of each of two locking devices 140(1) and 140(2) pass through slots 160(1) and 160(2) formed by base member 110(1). When panel 120(1) is in the closed position, ridges along sides 122(1) and 122(2) of center panel 120(1) engage grooves of side panels 130(1) and 130(2), as shown in FIG. 9. In the closed position, a key 150(1) can operate each of locking devices 140(1) and 140(2) so that locking tabs 145(1) and 145(2) engage base member 110(1). Thus, when center panel 120(1) in the closed position holds side panels 130(1) and 130(2) in place, locking tabs 145(1) and 145(2) engage base member 110(1) and key 150(1) is removed, system 100(1) is in a closed and relatively tamper-resistant configuration, with printed media visible through each of windows 180(1)-180(3).

FIG. 9 is a detail view showing how edge 122(1) of center panel 120(1) holds side panel 130(1) in place. FIG. 9 may not be drawn to scale. Center panel 120(1) forms a flange 125(1) at edge 122(1). Flange 125(1) fits within a groove 135(1) formed by side panel 130(1), as shown. Thus, flange 125(1) holds side panel 130(1) in place, in connection with flanges of side panel 130(1) sliding within grooves 170(1) of base member 110(1), as discussed in connection with FIG. 1.

Figure 10:
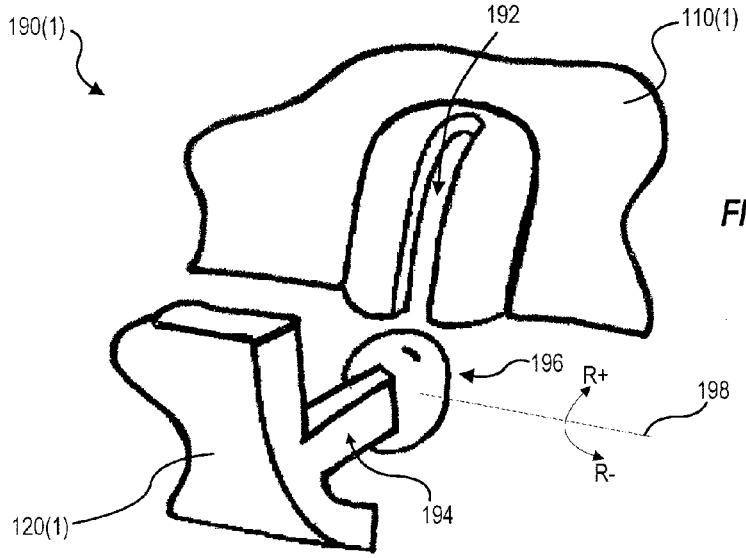
FIG. 10 is a detail view showing a hinge that may be utilized in media display systems to connect a center panel to a base member.

FIG. 10 is a detail view showing a hinge 190(1) that may be utilized in media display systems to connect a center panel to a base member (e.g., may be utilized by system 100(1) to connect center panel 120(1) to base member 110(1). FIG. 10 may not be drawn to scale. Base member 110(1) forms a slot 192. Center panel 120(1) forms an aim 194 that fits within slot 192, and a ball 196 that is larger than slot 192, so that when arm 194 is within slot 192, center panel 120(1) can rotate in directions R−, R+ with respect to base member 110(1) about a hinge axis 198. In normal use, when center panel 120(1) is in the closed position, panel 120(1) is rotated in the R+ direction and is held in place by locking devices 140(1) and/or 140(2) (shown in FIG. 1). FIG. 10 shows hinge 190(1) in the open position, with panel 120(1) rotated far enough in the R− direction that ball 196 and thus panel 120(1) are completely disengaged from base member 110(1). The ability to disengage center panel 120(1) easily from base member 110(1) may be advantageous when cleaning or replacement of center panel 120(1) is desired.

Figure 11:
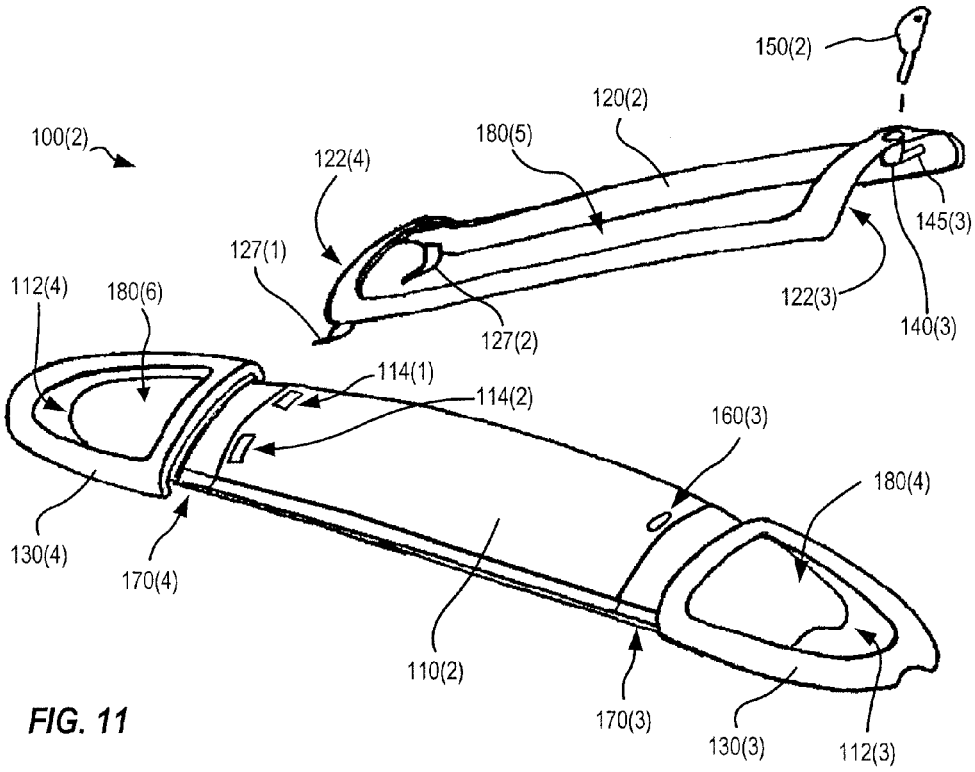
FIG. 11 shows an exploded view of another media display system that is attachable to a restraint bar of a ski-lift chair, in accord with an embodiment.

FIG. 11 shows an exploded view of a media display system 100(2) that is attachable to a restraint bar that lowers in front of a ski-lift chair (not shown). FIG. 11 may not be drawn to scale. Like system 100(1) (FIG. 1), system 100(2) may display printed media, and is configured for keyed access, as explained immediately hereafter.

System 100(2) includes a base member 110(2), a center panel 120(2) shown in an open position, and side panels 130(3) and 130(4) shown detached from base member 110(2). Side panels 130(3) and 130(4) form flanges (not shown) configured to slide into grooves 170(3) and 170(4) of base member 110(2). Each of center panel 120(2) and side panels 130(3) and 130(4) include a window 180(4)-180(6), as shown. Each of windows 180(4)-180(6) may include a transparent material such as glass or clear plastic, or windows 180(4)-180(6) may simply be openings in each of center panel 120(2) and side panels 130(3) and 130(4). Center panel 120(2) connects to base member 110(2) by means of hooks 127(1) and 127(2) that engage with holes 114(1) and 114(2) formed by base member 110(2) such that panel 120(2) can swing down into a closed position onto base member 110(2).

Installation of printed media into system 100(2) may begin with center panel 120(1) in the open position and side panels 130(3) and 130(4) at least partially removed from base member 110(2). Printed media may be placed on base member 110(2), or affixed to an underside of each of center panel 120(2) and side panels 130(3) and 130(4). Once printed media are in place, flanges of side panels 130(3) and 130(4) slide into grooves 170(3) and 170(4) until each of panels 130(3) and 130(4) abuts one of ends 112(3) and 112(4) of base member 110(2). Next, center panel 120(2) swings into a closed position, such that a locking tab 145(3) of a locking device 140(3) passes through a slot 160(3) formed by base member 110(2). When panel 120(2) is in the closed position, ridges along sides 122(3) and 122(4) of center panel 120(2) engage grooves of side panels 130(3) and 130(4), in the same manner as shown in FIG. 9 for panels 130(1). In the closed position, a key 150(2) can operate locking device 140(3) so that locking tab 145(3) engages base member 110(2). Thus, when center panel 120(2) in the closed position to hold side panels 130(3) and 130(4) in place, locking tab 145(3) engages base member 110(2) and key 150(2) is removed, system 100(2) is in a closed and relatively tamper-resistant configuration, with printed media visible through each of windows 180(4)-180(6).

Figure 12:
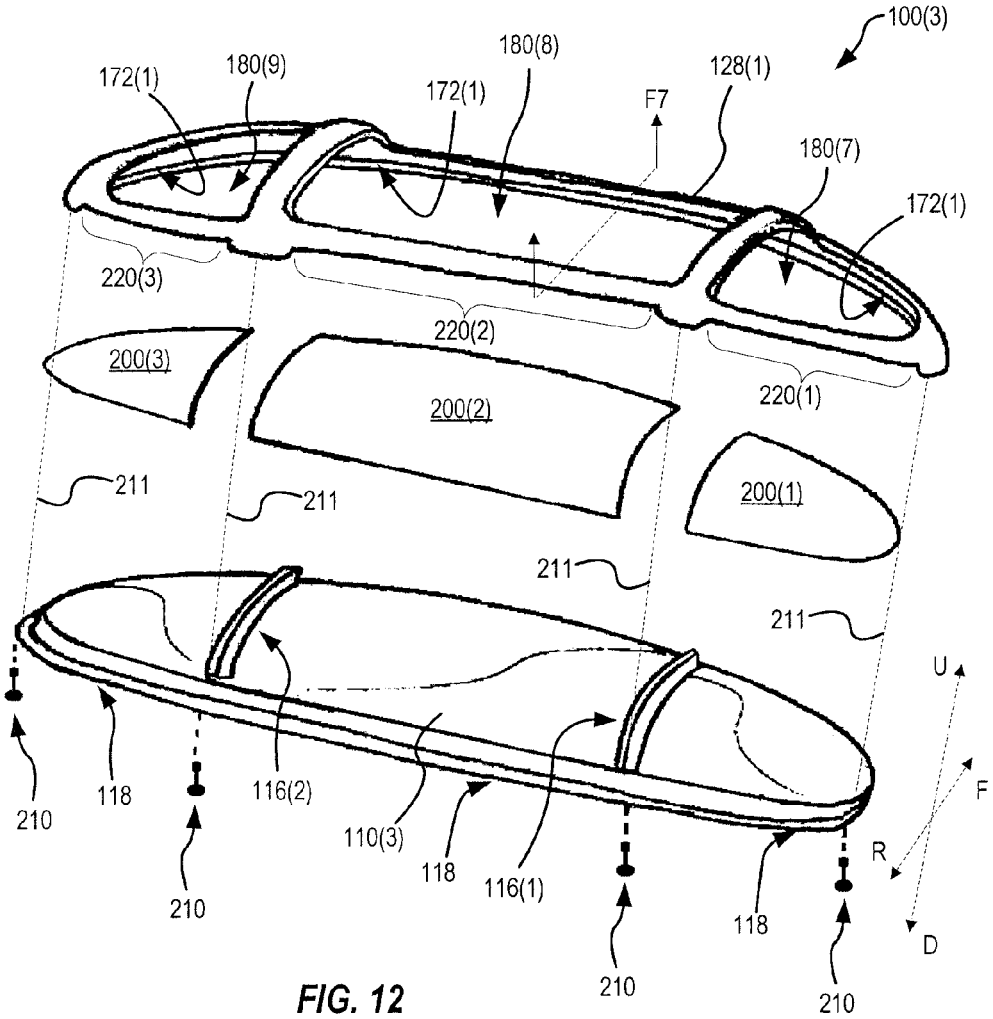
FIG. 12 shows an exploded view of a media display system that is attachable to a restraint bar of a ski-lift chair, in accord with an embodiment.

FIG. 12 shows an exploded view of a media display system 100(3) that is attachable to a restraint bar that lowers in front of a ski-lift chair (not shown). FIG. 12 may not be drawn to scale. Like systems 100(1) and 100(2) (FIG. 1, FIG. 11), system 100(3) may display printed media.

System 100(3) includes a base member 110(3) and a top panel 128(1) shown disengaged from base member 110(3). Base member 110(3) forms a flange 118 about a bottom surface of base member 110(3), and forms ribs 116(1), 116(2) that, along with top panel 128(1), hold printed media 200(1)-200(3) in place within system 100(3) so as to be visible through windows 180(7)-180(9), as shown. Each of windows 180(7)-180(9) may include a transparent material such as glass or clear plastic to protect printed media 200(1)-200(3), or windows 180(7)-180(9) may simply be openings in top panel 128(1). Top panel 128(1) connects to base member 110(3) by a groove 172(1) engaging with flange 118 along one edge, and connectors 210 fastening another edge. Lines 211 indicate the points of top panel 128(1) and base member 110(3) that connect via connectors 210. Connectors 210 may be of a type that brings top panel 128(1) into close contact with base member 110(3) when fully tightened, but only partially releases top panel 128(1) when loosened (e.g., each such connector 210 may continue to engage top panel 128(1) but allow top panel 128(1) limited movement with respect to base member 110(3) when loosened). Top panel 128(1) forms slots 220(1)-220(3) that facilitate installation and/or exchange of printed media 200(1)-200(3) as explained further below. A dashed line F7 indicates a location shown in cross section in FIG. 14A and FIG. 14B. In FIG. 12, a frontward (F) and rearward (R) direction are indicated by a short, dashed arrow, and an upward (U) and downward (D) direction are indicated by a longer dashed arrow that is approximately parallel to lines 211.

Figure 13:
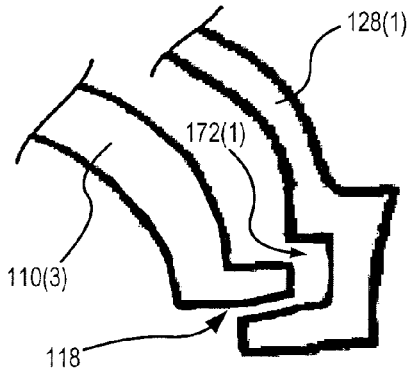
FIG. 13 shows a rear edge detail of the system of FIG. 12.

FIG. 13 shows a rear edge detail of system 100(3). Top panel 128(1) forms a groove 172(1) that extends about an edge of top panel 128(1) that is opposite an edge that attaches via connectors 210. (Although FIG. 12 shows groove 172(1) in a forward, swept edge and slots 220(1)-220(3) and connectors 210 in a rear, straight edge of top panel 128(1), it is appreciated that groove 172(1) may alternatively be in the rear edge, and slots 220(1)-220(3) and connectors 210 in the front edge.) Flange 118 engages groove 172(1), as shown, such that top panel 128(1) fastens to base member 110(3) along the length of an edge so engaged, so as to hold top member 128(1) to base member 110(3) if another edge is engaged (e.g., by connectors 210).

One method of installing printed media 200(1)-200(3) into system 100(3) includes removing top panel 128(1) completely (for example, as shown in FIG. 12), placing the printed media onto base member 100(3), manipulating top panel 128(1) to engage groove 172(1) with flange 118, then fastening connectors 210.

Figure 14A:
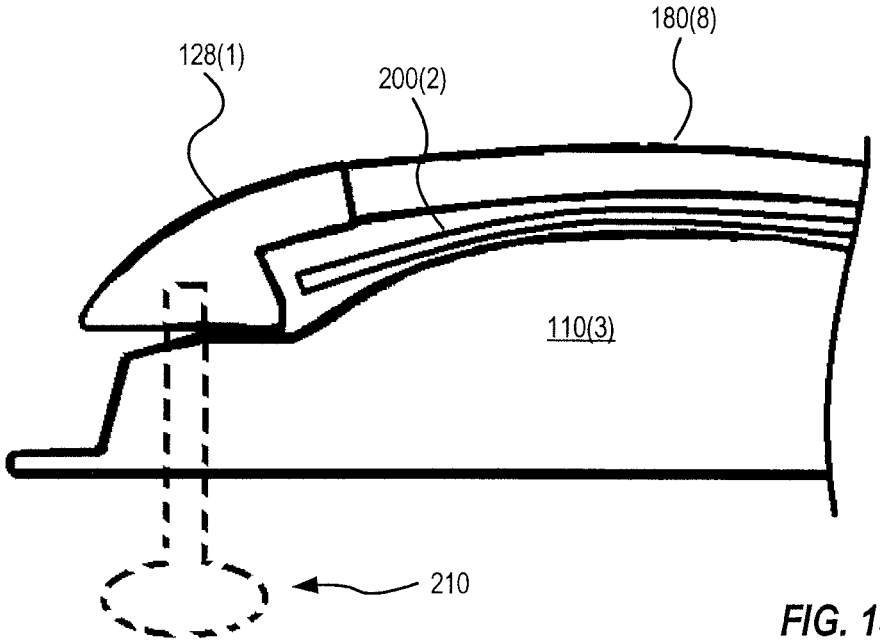
FIG. 14A and FIG. 14B are alternate views showing a partial cross-section of the system of FIG. 12 in a closed and an open position, respectively.
Figure 14B:
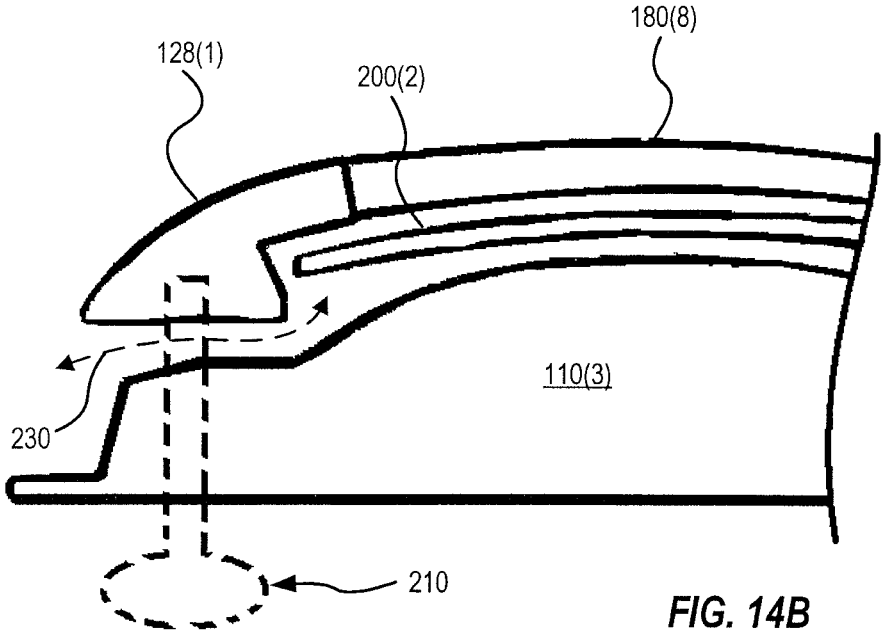

A second method of installing printed media 200(1)-200(3) into system 100(3) is illustrated in FIGS. 14A and 7B. FIG. 14A is one alternate view showing a partial cross-section along line F7 shown in FIG. 12. In FIG. 14A, a connector 210 (not in plane F7, thus shown in dashed lines) holds top panel 128(1) in place so that top panel 128(1) seats against base member 110(3), holding printed media 200(2) in place. FIG. 14B is another alternate view showing a partial cross-section along line F7 shown in FIG. 12. In FIG. 14B, connector 210 is loosened such that top panel 128(1) remains fastened to base member 110(3), but can move so as to open a channel 230 that permits access to printed media 200(2), permitting removal or replacement of media 200(2).

Figure 15:
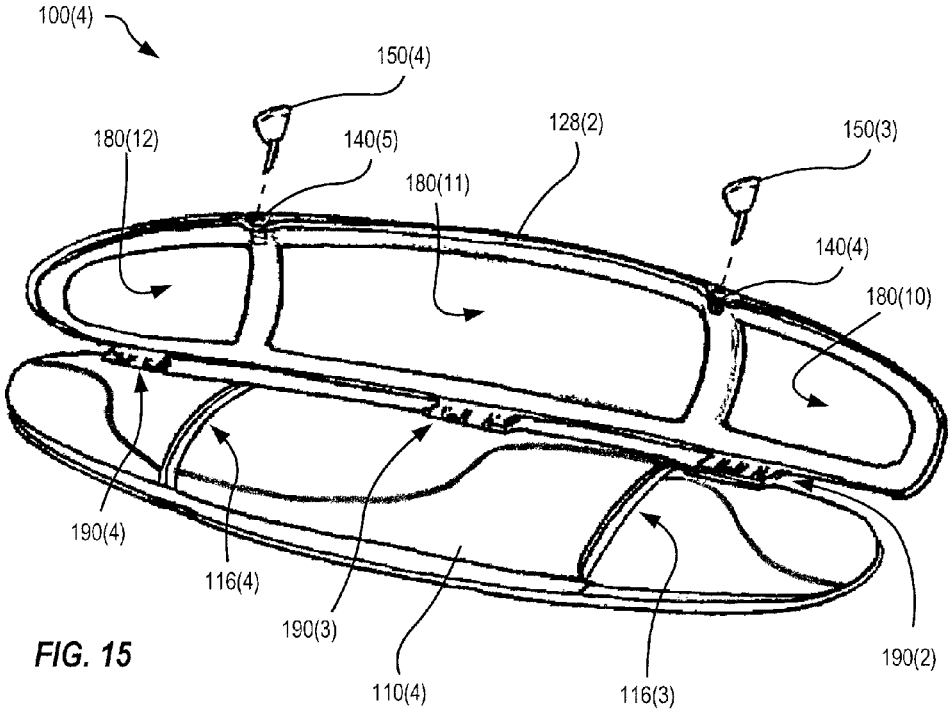
FIG. 15 shows an exploded view of a media display system that is attachable to a restraint bar of a ski-lift chair, in accord with an embodiment.

FIG. 15 shows a media display system 100(4) that is attachable to a restraint bar that lowers in front of a ski-lift chair (not shown). FIG. 15 may not be drawn to scale. Like systems 100(1) and 100(2) (FIG. 8 and FIG. 11), system 100(4) may display printed media, and is configured for keyed access, as explained immediately hereafter.

System 100(4) includes a base member 110(4) and a top panel 128(2) that connects to base member 110(4) via hinges 190(2)-190(4). Although three hinges 190(2)-190(4) are shown, it is appreciated that any number or style of hinges are within the scope of the present disclosure. FIG. 15 shows top panel 128(2) in an open position. Top panel 128(2) includes windows 180(10)-180(12), as shown; each of windows 180(10)-180(12) may include a transparent material such as glass or clear plastic, or windows 180(10)-180(12) may simply be openings in top panel 128(2). Base member 110(4) forms ribs 116(3), 116(4) that, along with top panel 128(2), hold printed media (not shown in FIG. 15) in place within system 100(4) so as to be visible through windows 180(10)-180(12), as shown.

Installation of printed media into system 100(4) may begin with top panel 128(2) in the open position. Printed media may be placed on base member 110(4), or affixed to an underside of top panel 128(2). Once printed media are in place, top panel 128(2) may swing down into a closed position, so that keys 150(3) and 150(4) may lock locking devices 140(4) and 140(5) respectively to base member 110(4), locking top panel 128(2) in the closed position, with printed media visible through windows 180(10)-180(12). It is appreciated that a single key (e.g., either of keys 150(3) and 150(4)) may operate both of locking devices 140(4) and 140(5).

Figure 16:
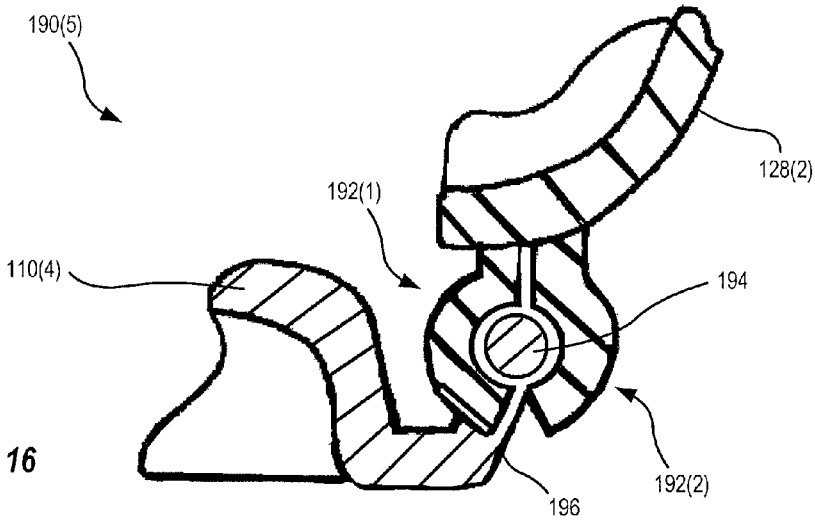
FIG. 16 is a detail view of a hinge that may be used as one or more of the hinges in the system of FIG. 15.

FIG. 16 is a detail view of a hinge 190(5) that may be used, for example, as one or more of hinges 190(2)-190(4), FIG. 15. Base member 110(4) forms an extension 196 that includes an axle 194. Top panel 128(2) forms flanges 192(1) and 192(2) that may snap into place about axle 194.

Figure 17:
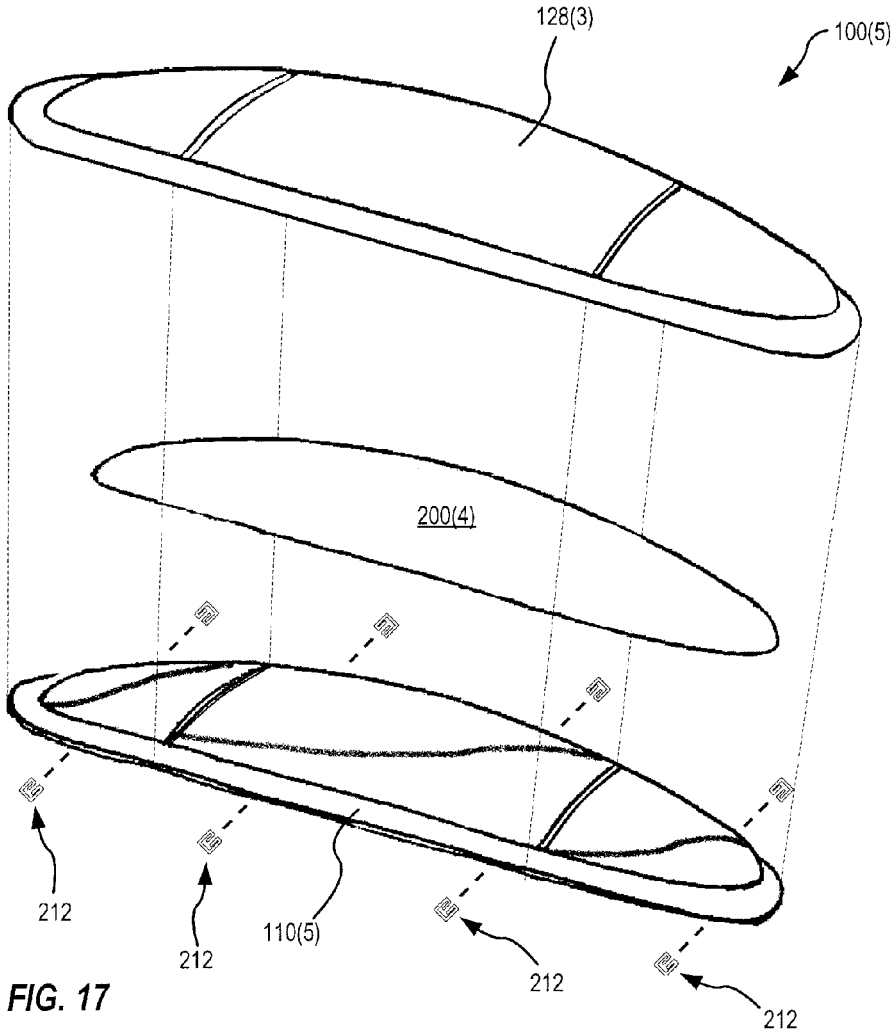
FIG. 17 shows an exploded view of a media display system that is attachable to a restraint bar of a ski-lift chair, in accord with an embodiment.

FIG. 17 shows a media display system 100(5) that is attachable to a restraint bar that lowers in front of a ski-lift chair (not shown). FIG. 17 may not be drawn to scale. System 100(5) includes a base member 110(5) and a transparent top panel 128(3) that are held together with clips 212 (only some of clips 212 are numbered in FIG. 17, for clarity of illustration). Base member 110(5) may be formed, for example, of structural foam and top panel 128(3) may be formed of a clear plastic such as Plexiglas that is vacuum formed to the shape of base member 110(5). Printed media 200(4) is held between base member 110(5) and top panel 128(3), and are visible through top panel 128(3). Although printed media 200(4) is shown as a single article in system 100(5), it is appreciated that printed media can be of any number and shape.

Figure 18:
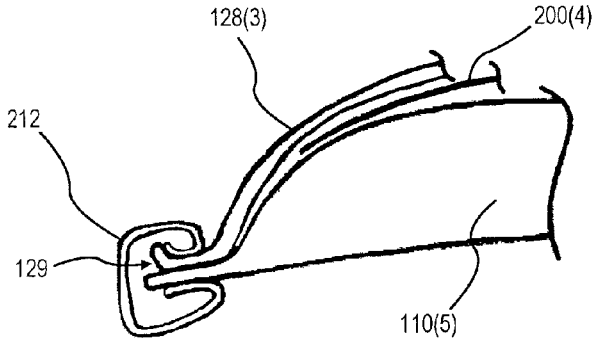
FIG. 18 is a detail view showing one clip holding together a top cover, printed media and base member of the system of FIG. 17.

FIG. 18 is a detail view showing one clip 212 holding together top cover 128(3), printed media 200(4) and base member 110(5). Clip 212 may be formed, for example, of spring steel. Top cover 128(3) may form a flange 129 that clip 212 snaps over, in order to hold clip 212 in place (although it is appreciated that not only top cover 128(3) but also base member 110(5) or both may have flanges like flange 129 to hold clip 212 in place).

Figure 19:
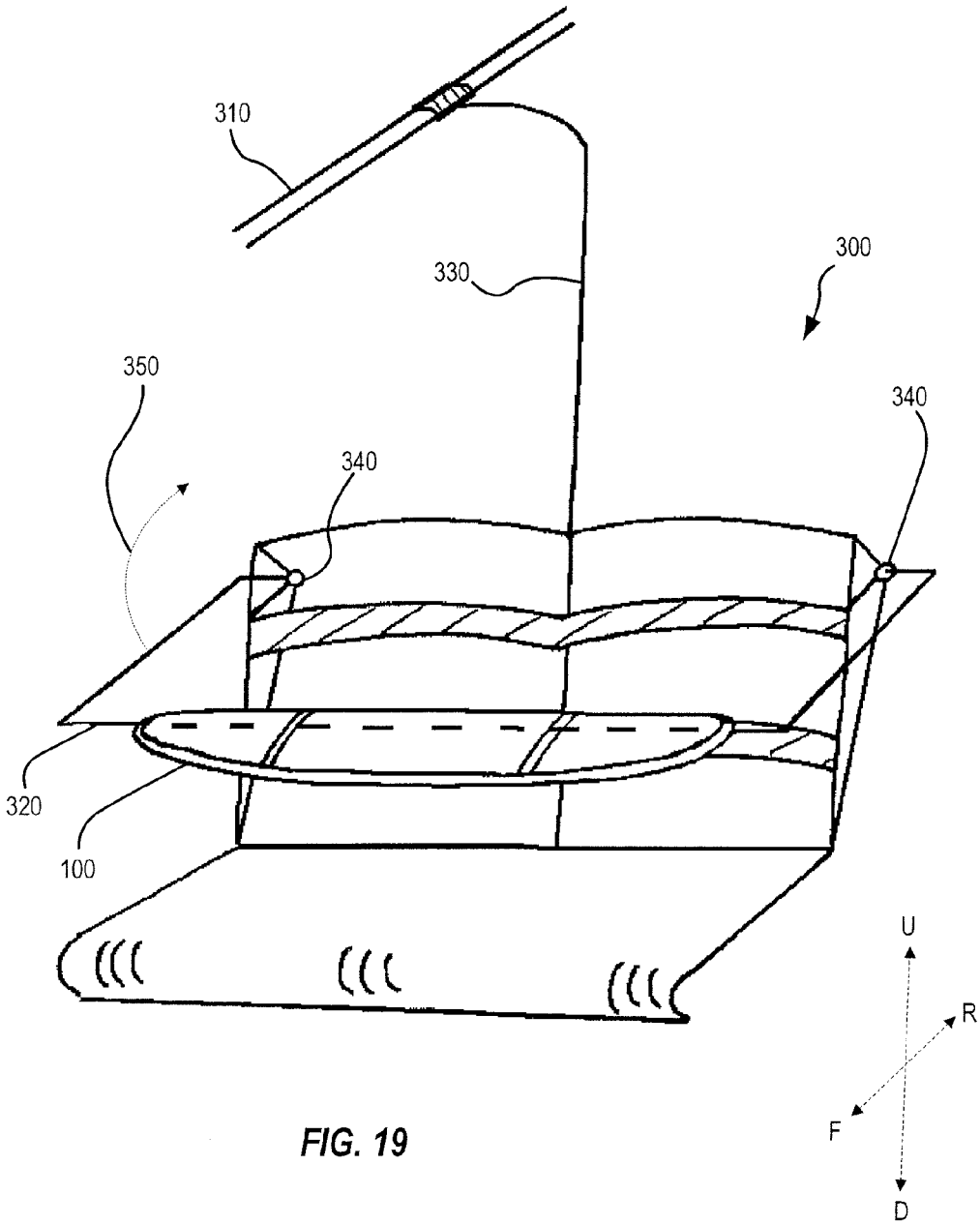
FIG. 19 illustrates a media display system installed on a ski-lift chair.

FIG. 19 illustrates a media display system 100 (e.g., any of media display systems 100(1)-100(5)) installed on a ski-lift chair 300. Chair 300 is suspended from cable 310, and has a restraint bar 320 shown in a "down" position. In FIG. 19, a frontward (F) and rearward (R) direction are indicated by a short, dashed arrow, and an upward (U) and downward (D) direction are indicated by a longer dashed arrow that is approximately parallel to a pole 330 that suspends chair 300. Restraint bar 320 may also assume an "up" position by rotating it in the direction of arrow 350 about one or more pivots 340. A rider of chair 300 typically boards the chair with restraint bar 320 in the "up" position, and once chair 300 lifts the rider off the ground, the rider pulls restraint bar 320 into the "down" position shown. It is appreciated that chair 300 and restraint bar 320 may take differing forms, or mount with one another differently, as compared to the configuration shown in FIG. 19 without departing from the scope hereof.

Figure 20:
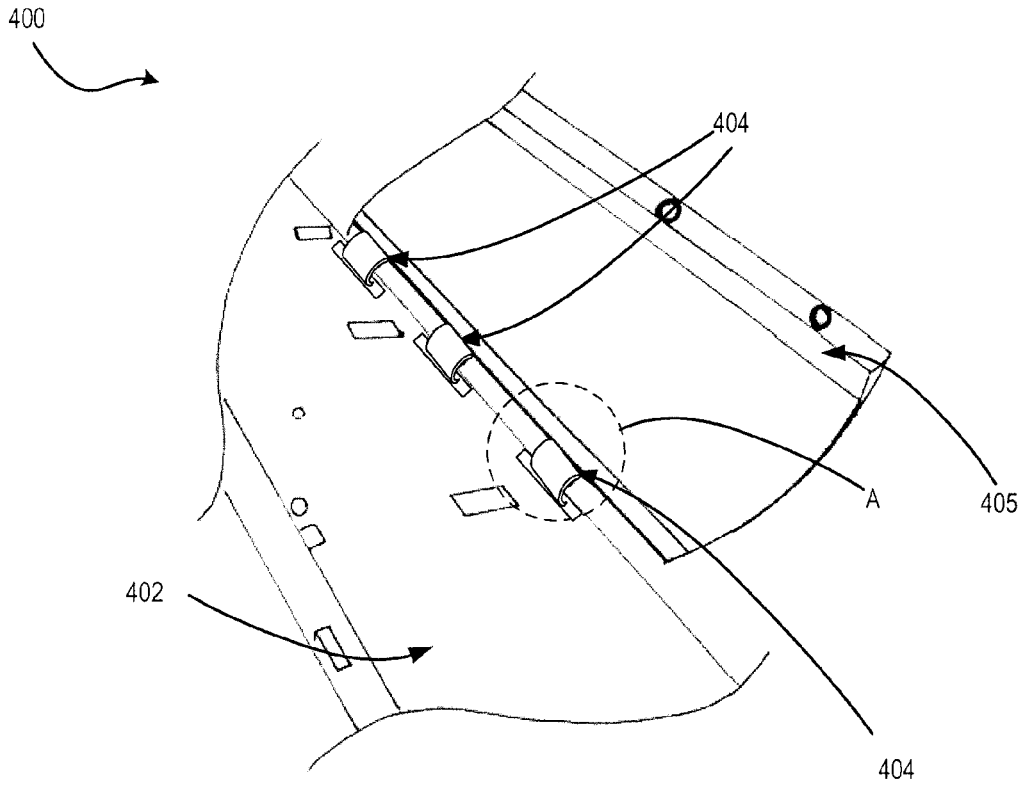
FIG. 20 shows a portion of a media display system for a ski-lift chair.

FIG. 20 shows a portion of a media display system 400 for a ski-lift chair. System 400 includes a base member 402 and a frame 405 that connects to base member 402 via three hinge hooks 404 (only portions of base member 402 and frame 405 are shown in FIG. 20). Although three hinge hooks 404 are shown in the partial view of FIG. 20, it is appreciated that any number or style of hinge hooks may be utilized. FIG. 20 shows frame 405 in an open position. Frame 405 may be, for example, a center frame or a side frame of system 400. A region noted as A is shown in greater detail below in FIG. 21 and FIG. 22; other features of system 400 are shown in FIG. 23 and FIG. 24.

Figure 21:
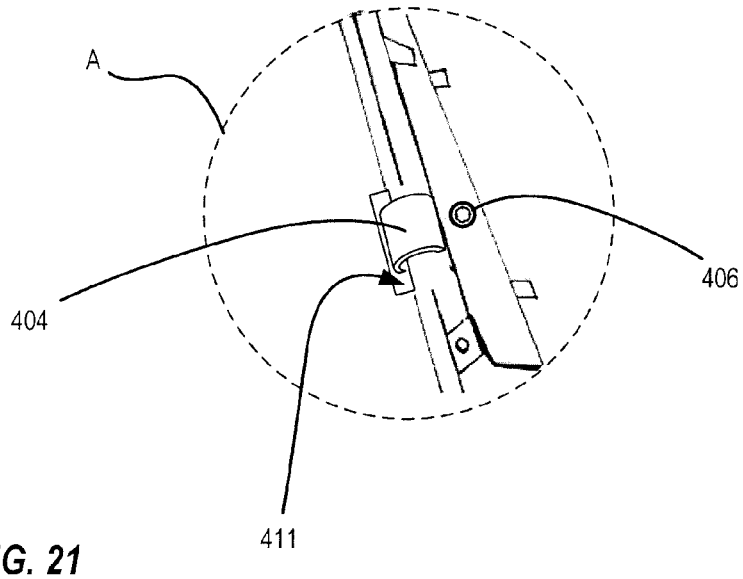
FIG. 21 is an enlarged view of a region shown in FIG. 20.

FIG. 21 is an enlarged view of region A shown in FIG. 20. FIG. 21 shows hinge hook 404 attached to frame 405 with a screw 406. Alternatively, rivets or other mechanical fasteners may be utilized to attach hinge hook 404 to frame 405.

Figure 22:
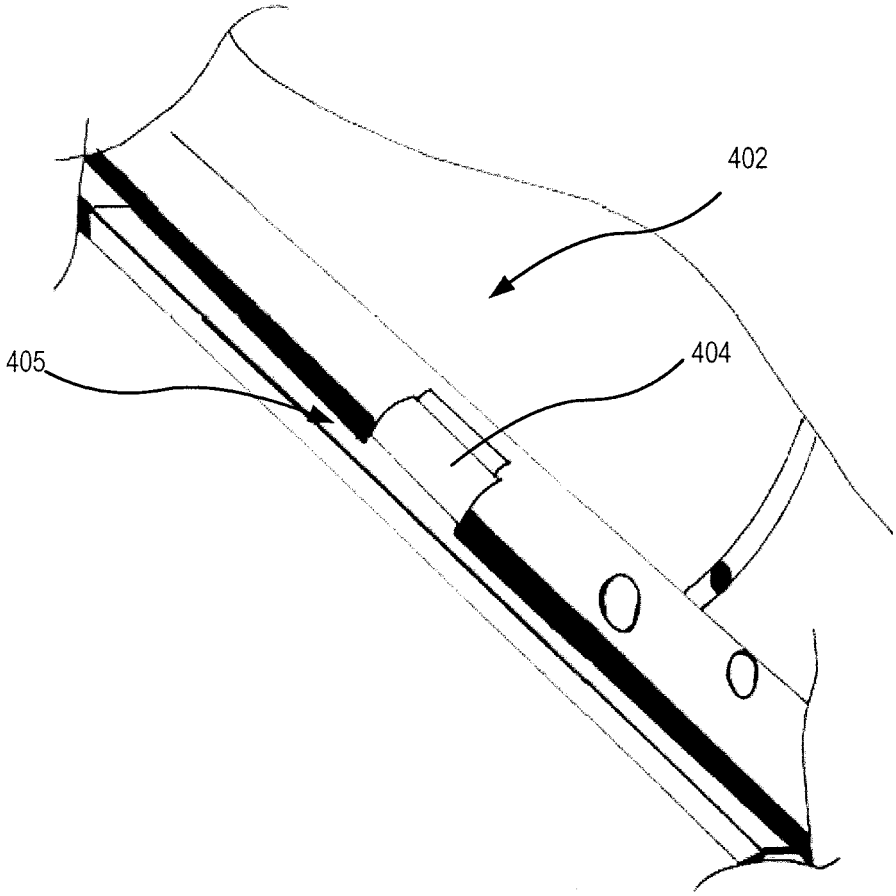
FIG. 22 is a rear view of a region shown in FIG. 20, with a frame of the media display system in a closed position over a base member of the system.

FIG. 22 is a rear view of region A of FIG. 20 where base member 402 connects to frame 405 via hinge hook 404, but with frame 405 in a closed position over base member 402.

Figure 23:
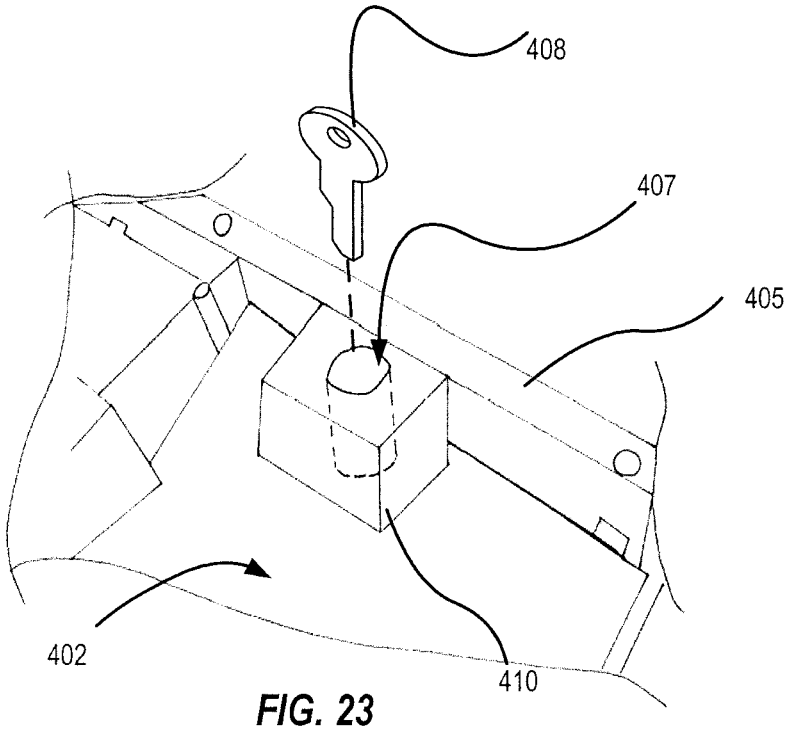
FIG. 23 shows a locking mechanism positioned on an underside of a base member of the media display system of FIG. 20.
Figure 24:
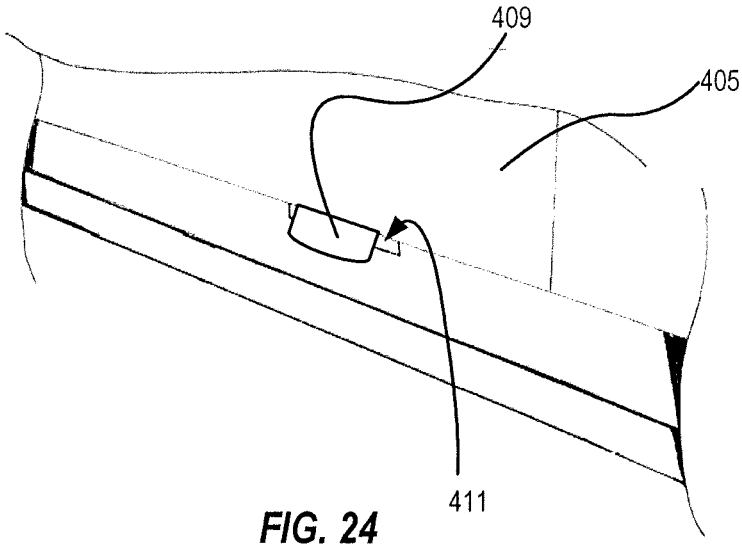
FIG. 24 shows a latch engaged in a slot of a frame of the media display system of FIG. 20.

FIG. 23 shows a locking mechanism 410 positioned on an underside of base member 402. Although FIG. 23 shows locking mechanism 410 integrated with base member 402, it is appreciated that locking mechanism 407 may also be positioned in frames of a media display system (e.g., frame 405). Locking mechanism 410 includes a lock 407 and a latch 409, and is operated by a key 408. Printed media (e.g., printed media 60, 62, 64 or 200) may be affixed to an underside of frame 405 or placed on base member 402 such that when frame 405 swings down into a closed position (as shown, for example, in FIG. 24) frame 405 holds the printed media in place.

FIG. 24 shows a latch 409 engaged in a slot 411 of frame 405 of media display system 400. After frame 405 is closed, key 408 operates lock 407 to move latch 409 of locking mechanism 410 into slot 411, locking frame 405 to base member 402.

The changes described above, and others, may be made in the media display systems for ski-lift chairs described herein without departing from the scope hereof. For example, each of base members 22 or 110 or 402, center panels 50 or 120, side panels 52, 54 or 130, top covers 128 and frame 405 may be formed of a wide variety of materials such as plastic, metal, hard rubber, epoxies, fiberglass, and/or combinations thereof. Indicia may be embossed, etched, or molded into any of base members 22 or 110, center panels 50 or 120, side panels 52, 54 or 130, top covers 128, and frame 405. Tabs 58, hinges 190, hooks 127, hinge hook 404, locking mechanisms 140 or 410, locking tabs 145 are not limited to the exact form and/or placement shown; in particular, it is appreciated that illustrated arrangements of hinges and fasteners may be reversed front-to-rear or side-to-side. Locking devices in base members, that engage panels or covers, may be substituted for locking devices in such panels or covers that engage a base member. Locking devices may be operated by tools other than keys. Media display systems for ski-lift chairs may include flanges or overhangs in addition to those shown, to increase weather resistance or tamper resistance of such systems. Windows 180 may be formed of glass or plastic, or may be omitted entirely. Printed media 60, 62, 64 or 200 may be printed on paper or plastic or combinations thereof, such as plastic laminated about paper. Media display systems for ski-lift chairs are not limited to the illustrated configurations of center and side panels but may include different numbers and arrangements of panels.

It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. Apparatus for displaying printed media, comprising:

a base member including a plurality of topside recesses and associated blocks that insert into the topside recesses;

metal clamps for non-rotationally securing the base member to a restraint bar of a ski-lift chair, the metal clamps securing to the base member opposite the plurality of recesses; and a top panel coupled with the base member and with the printed media, the top panel forming a plurality of windows for viewing the printed media therethrough;

wherein the base member and top panel, when coupled together, include:

a width, a length less than the width and corresponding to the distance from a front edge of the apparatus to an opposing rear edge of the apparatus, a thickness equal or less than one half the length and less than one third of the width, and a top surface that is convex along the length from the front to rear edge; and wherein the widthwise direction is substantially parallel to the restraint bar.

2. Apparatus of claim 1, the top panel being transparent.

3. Apparatus of claim 2, the top panel comprising clear plastic having at least several mils thickness.

4. Apparatus of claim 1, further comprising the printed media.

5. Apparatus of claim 1, wherein the top panel is disposed atop the base member, the clamps are disposed beneath the base member.

6. Display apparatus for printed media, comprising:

a body member having a bottom surface and a top surface including a plurality of topside recesses and blocks inserted into the topside recesses;

a frame member for mounting over the top surface of the body member and holding the printed media between the frame member and the body member the frame having an aperture forming a viewing region through which the printed media is viewable; and two or more metal holding clamps coupled to the bottom surface of the body member, opposite of the plurality of topside recesses, for non-rotationally attaching the display apparatus to a restraint bar of a ski-lift chair;

wherein the body member and frame member, when coupled together, include:

a width, a length less than the width and corresponding to the distance from a front edge of the display apparatus to an opposing rear edge of the display apparatus, a thickness equal or less than one half the length and less than one third of the width, and, a top surface that is convex along the length from the front to rear edge; and wherein the widthwise direction is substantially parallel to the restrain bar.

7. Display apparatus of claim 6, further comprising one or more fasteners for coupling the frame member to the body member.

8. Display apparatus of claim 6, two or more metal holding clamps non-rotatably attaching the display apparatus to the restraint bar of the ski-lift chair.

9. Display apparatus of claim 6, the frame member coupled with the body member such that the printed media is insertable between the base member and the frame member.

10. Apparatus for displaying printed media, comprising:

a ski-lift chair having a restraint bar;

a body member having a bottom surface and a top surface including a plurality of topside recesses and blocks that insert into the topside recesses;

two or more metal holding clamps coupled to the bottom surface of the body member, opposite of the plurality of topside recesses, that non-rotatably attach the display apparatus to the restraint bar;

a frame member comprising a top panel that mounts over the top surface of the body member; and printed media that is integrated with the top panel for visibility to a rider of the ski-lift chair, the printed media visible through a plurality of windows within the top panel;

wherein the body member and frame member, when coupled together, include:

a width, a length less than the width and corresponding to the distance from a front edge of the apparatus to an opposing rear edge of the apparatus, a thickness equal or less than one half the length and less than one third of the width, and a top surface of the apparatus that is convex along the length from the front to rear edge; and wherein the widthwise direction is substantially parallel to the restraint bar.

11. A method of advertising at a ski area, comprising coupling base members to respective top panels to form a plurality of advertising displays such that the advertising displays form:

a width, a length less than the width and corresponding to the distance from a front edge of the advertising display to an opposing rear edge of the advertising display, a thickness equal or less than one half the length and less than one third of the width, and a top surface that is convex along the length from the front to rear edge;

non-rotatably integrating the plurality of advertising displays with a respective restraint bar of ski-lift chairs of the ski area, each of the advertising displays having one or more places to secure printed media and being integrated to the restraint bar via metal clamps securing to a bottom surface of the base member of the advertising display, the metal clamps securing opposite of a plurality of topside recesses within each base member, wherein the step of non-rotatably integrating includes inserting a block within each respective topside recess to support the printed media; and inserting printed media within each of the plurality of advertising displays;

wherein the restraint bar is substantially parallel to the widthwise direction.

12. The method of claim 11, inserting comprising inserting one or more of a trail map, ski-lift instructions, safety information and advertising material as the printed media.

13. The method of claim 11, integrating comprising providing each of the advertising displays with a plurality of the places to secure the printed media.

14. The method of claim 13, integrating comprising providing each of the advertising displays with three of the places to secure the printed media, and wherein inserting comprises inserting a trail map and two items of advertising material within the three places.

15. An advertising method, comprising:

coupling base members to respective top panels to form a plurality of media display systems such that each media display system forms:

a width, a length less than the width and corresponding to the distance from a front edge of the media display system to an opposing rear edge of the media display system, a thickness equal or less than one half the length and less than one third of the width, and a top surface that is convex along the length from the front to rear edge;

non-rotatably integrating the media display systems onto respective restraint bars of a plurality of ski-lift chairs, each of the media display systems forming one or more locations to display printed media therein, each of the media display systems being integrated via clamps securing to a bottom surface of the base member of the media display system, the clamps securing opposite a plurality of topside recesses within each base member, wherein the step of non-rotatably integrating includes inserting a block within each respective topside recess to support the printed media; and displaying printed media, comprising a trail map and one or more of ski-lift instructions, safety information and advertising material, in each of the locations such that the printed media is visible to a person sitting on one of the ski-lift chairs;

wherein the widthwise direction is substantially parallel to the restraint bar.

16. A method of advertising at a ski area, comprising:

coupling base members to respective top panels to form a plurality of media display systems such that the media display systems form:

a width, a length less than the width and corresponding to the distance from a front edge of the media display system to an opposing rear edge of the media display system, a thickness equal or less than one half the length and less than one third of the width, and a top surface that is convex along the length from the front to rear edge;

integrating printed media, comprising advertising and a trail map, within viewable regions of at least one of the plurality of media display systems; and non-rotatably integrating respective media display systems with a restraint bar of a ski-lift chair of the ski area, the media system being integrated via clamps securing to a bottom surface of the base member of the media display system, the clamps securing opposite a plurality of topside recesses within each base member, wherein the step of non-rotatably integrating includes inserting a block within each respective topside recess to support the printed media;

wherein the widthwise direction is substantially parallel to the restraint bar.

17. The method of claim 16, integrating the printed media comprising integrating the printed media with plastic that is at least several mils in thickness.

18. The method of claim 16, integrating the printed media comprising providing one or more of ski-lift instructions and safety information, in addition to the advertising and the trail map, as the printed media.

19. The method of claim 18, further comprising selling or leasing the advertising as a revenue source.

* * * * *

UNITED STATES PATENT AND TRADEMARK OFFICE

CERTIFICATE OF CORRECTION

PATENT NO. : 8,782,933 B2
APPLICATION NO. : 13/350433
DATED : July 22, 2014
INVENTOR(S) : Matthew Jay It is certified that error appears in the above-identified patent and that said Letters Patent is hereby corrected as shown below:

In the Specification

Column 5, Line 58, “faun” should read --form--;
Column 6, Line 41, “aim” should read --arm--;

In the Claims

Column 12, Line 33, “inserting comprising” should read --the step of inserting printed media comprising--; Lines 36 and 39, “integrating comprising” should read --the step of non-rotatably integrating comprising--.

Signed and Sealed this
Twenty-first Day of July, 2015

Michelle K. Lee

Michelle K. Lee
*Director of the United States Patent and Trademark Office*